United States Patent [19]

Korpics

[11] 4,192,240

[45] Mar. 11, 1980

[54] PEDESTAL ROOF WEAR LINER

[75] Inventor: Frank J. Korpics, Streamwood, Ill.

[73] Assignee: AMSTED Industries Incorporated, Chicago, Ill.

[21] Appl. No.: 895,781

[22] Filed: Apr. 12, 1978

[51] Int. Cl.[2] ..... B61F 5/32; B61F 5/38; B61F 5/50; B61F 15/20

[52] U.S. Cl. ..... 105/225; 105/224 R; 105/224.1

[58] Field of Search ..... 105/225, 218 R, 224 R, 105/224 A, 224.1

[56] References Cited

U.S. PATENT DOCUMENTS

| | | | |
|---|---|---|---|
| 3,381,629 | 5/1968 | Jones | 105/224.1 X |
| 3,638,582 | 2/1978 | Beebe | 105/224.1 X |
| 3,897,736 | 8/1975 | Tack | 105/225 |
| 4,034,681 | 7/1977 | Neumann et al. | 105/225 |

FOREIGN PATENT DOCUMENTS

| | | | |
|---|---|---|---|
| 612455 | 1/1961 | Canada | 105/225 |
| 707729 | 4/1954 | United Kingdom | 105/225 |

*Primary Examiner*—Joseph F. Peters, Jr.
*Assistant Examiner*—Howard Beltran
*Attorney, Agent, or Firm*—Edward J. Brosius; Fred P. Kostka; John L. Schmitt

[57] ABSTRACT

A wear liner is provided for the roof of the pedestal jaw of a side frame. Movement of the wear liner relative to the pedestal roof is inhibited by projections extending upwardly from the lateral edges of the wear liner and/or depending legs which extend from the wear liner and cooperate with the stop lugs of the pedestal jaw. The need for conventional welding is reduced or eliminated.

4 Claims, 9 Drawing Figures

PEDESTAL ROOF WEAR LINER

BACKGROUND AND SUMMARY OF THE INVENTION

This invention relates to improved pedestal type side frames, useful, for example, in trucks for railway vehicles. More particularly, the invention relates to such side frames wherein improved and longer lasting wear protection is obtained.

Wear liners are often provided between the bearing adapter and the roof of the pedestal jaw of a side frame in which a roller bearing assembly is received. Such wear liners act to reduce wear in the pedestal roof caused by oscillating motions of the side frame relative to the wheel and axle assembly. These wear liners are often welded to the pedestal roof. Under heavy duty, e.g., high speed service, these welds tend to fail. When these welds fail, the wear liner may become displaced or even lost, thus resulting in increased and undesirable wear in the pedestal roof. Clearly, it would be advantageous to provide an improved means for securing the wear liner in place.

Therefore, one object of the present invention is to provide an improved pedestal type side frame.

Another object of the invention is to provide an improved wear liner for use in a pedestal type side frame.

A still further object of the invention is to provide an improved pedestal type side frame in which the wear liner is maintained securely in place. Other objects and advantages of the present invention will become apparent hereinafter.

An improved pedestal type side frame has now been discovered. Such side frames involve an integrally formed downwardly open jaw which includes a roof and depending legs, which legs have substantially opposed stop lugs. A bearing assembly is received in the jaw. A bearing adapter overlays this bearing assembly and a wear liner is disposed between the roof and adapter to, for example, reduce or eliminate wear on the roof. In one embodiment the present improvement comprises utilizing a wear liner which includes at least two projections, i.e., one pair of projections, extending upwardly from the lateral edges of the wear liner. These projections are positioned so as to cooperate, e.g., be engageable, with at least a portion of the lateral edges of the pedestal roof and thereby inhibit movement of the wear liner, e.g., in the longitudinal direction, relative to the pedestal roof. Preferably, the substantially mutually opposing projections of the wear liner act to provide a spring type retaining means to inhibit the wear liner from moving in the longitudinal direction relative to the pedestal roof.

Many of the embodiments of the present side frame do not require that the wear liner be attached, e.g., welded to the pedestal roof. However, in certain embodiments of the present invention, such attachment provides additional benefits. For example, in one preferred embodiment, the wear liner is attached, preferably welded, to the pedestal roof by attaching, e.g., welding, at least portions of two of the wear liner projections to the pedestal roof. Such attachment is neither directly above nor below the wear surface of the liner and, therefore, has increased resistance to failure.

In a further preferred embodiment, the wear liner includes at least two substantially mutually opposing downwardly depending legs which terminate closely adjacent to the substantially opposed stop lugs. These downwardly depending legs and stop lugs are positioned so as to be capable of cooperating to inhibit the movement of the wear liner, e.g., in the lateral direction, relative to the pedestal roof, for example, in the event of weld failure. In one embodiment, the present invention provides a side frame wherein the wear liner is inhibited from moving in the longitudinal direction by upwardly extending projections and from moving in the lateral direction by downwardly depending legs. In this embodiment, no welding or other means of attaching the wear liner to the pedestal roof is required. However, such attachment techniques may be employed to provide an extra measure wear liner movement prevention.

In general, and except as otherwise provided for herein, the side frame of the present invention may be fabricated from any suitable material or combination of materials of construction. The material of construction used for each component of the present apparatus may be dependent upon the particular application involved. Of course, the side frame should be made of materials which are substantially unaffected, except for normal wear and tear, by the conditions at which the apparatus is normally operated.

These and other aspects and advantages of the present invention are set forth in the following detailed description and claims, particularly when considered in conjunction with the accompanying drawings in which like parts bear like reference numerals.

DESCRIPTION OF THE PREFERRED EMBODIMENT

Figure 1:
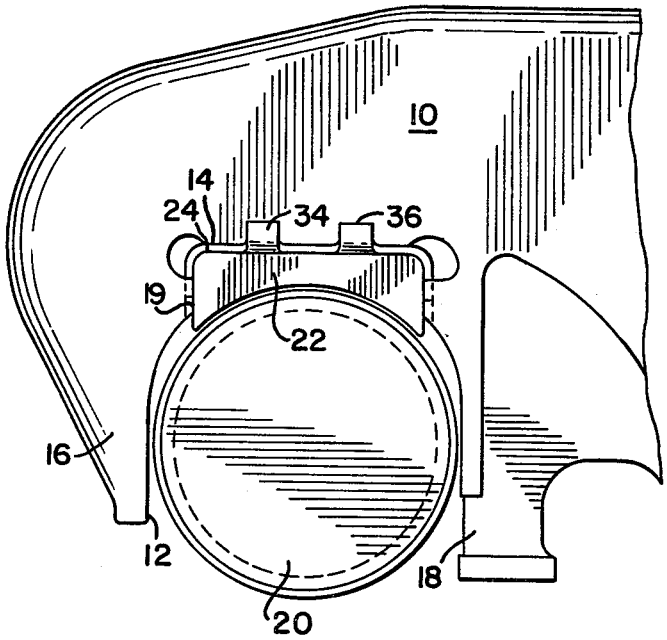
FIG. 1 is a partial front view of one end of a pedestal type side frame including one embodiment of the present invention.
Figure 4:
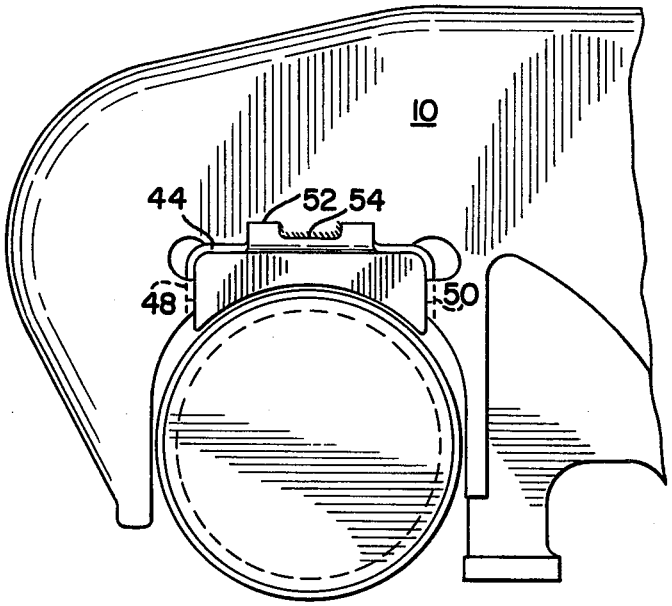
FIG. 4 is a partial front view of one end of a pedestal type side frame including another embodiment of the present invention.
Figure 7:
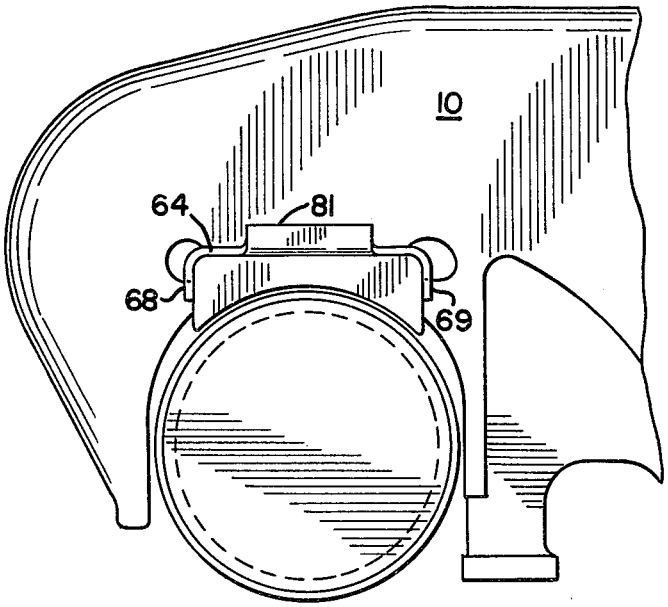
FIG. 7 is a partial front view of one end of a pedestal type side frame including a further embodiment of the present invention.

Referring not to the drawings, and particularly to FIGS. 1, 4, and 7, a pedestal type side frame is indicated generally at 10 and includes a downwardly open jaw 12 defined by pedestal roof 14 and depending legs 16 and 18. It should be understood that a side frame is symmetrical longitudinally and each end includes a pedestal jaw 12. The pedestal jaw 12 is arranged to receive a conventional roller bearing assembly 20 and a bearing adapter 22 which is restrained from lateral movement by a pair of opposed stop lugs 19.

Figure 3:
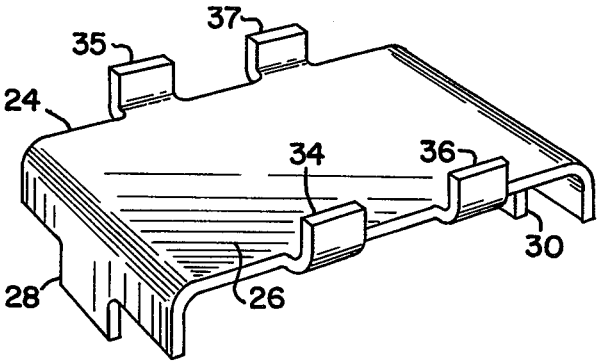
FIG. 3 is a top perspective view of the wear liner used in the structure of FIG. 1.
Figure 2:
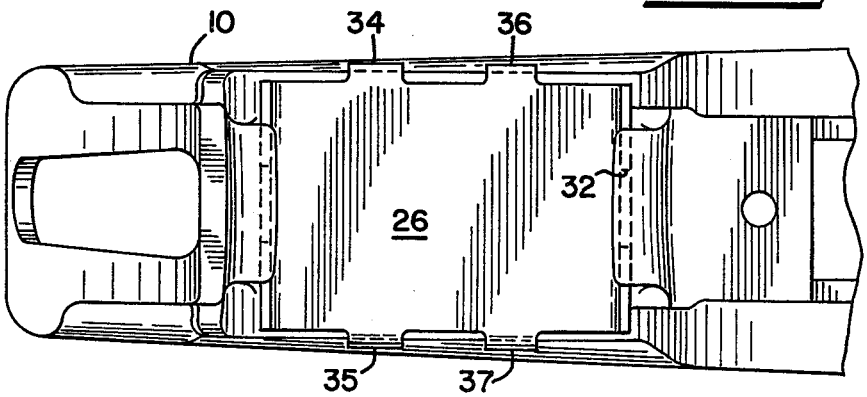
FIG. 2 is a bottom view of the structure of FIG. 1 with certain parts removed for clarity.
Figure 6:
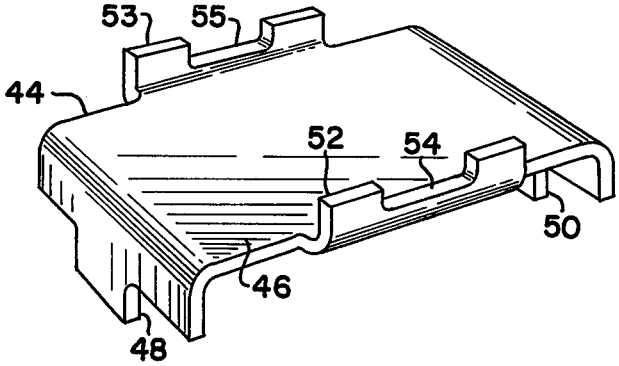
FIG. 6 is a top perspective view of the wear liner used in the structure of FIG. 4.
Figure 5:
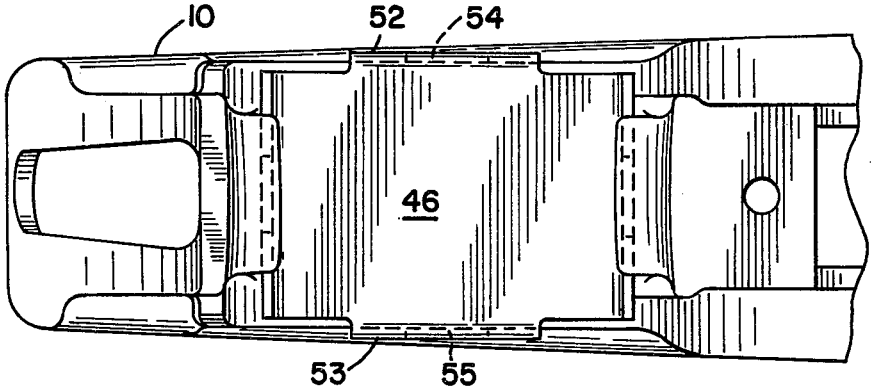
FIG. 5 is a bottom view of the structure of FIG. 4 with certain parts removed for clarity.
Figure 9:
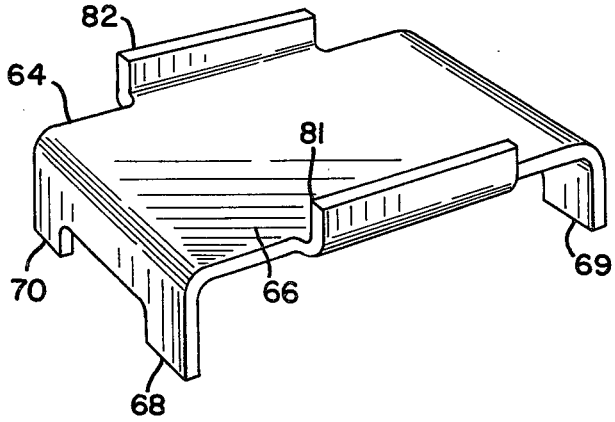
FIG. 9 is a top perspective of the wear liner used in the structure of FIG. 7.
Figure 8:
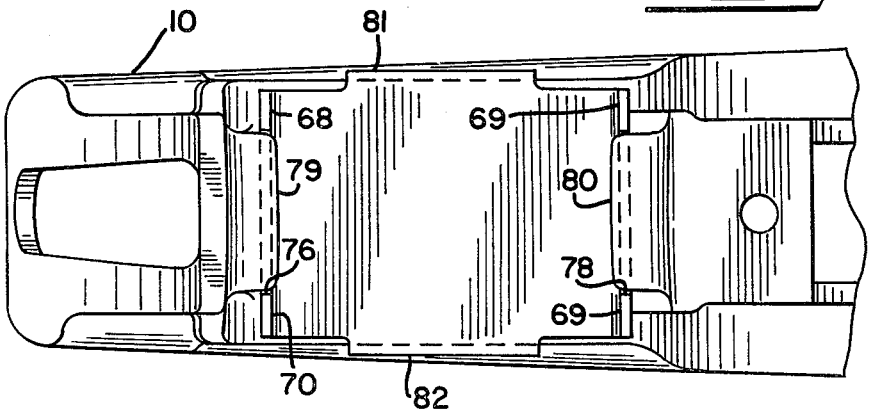
FIG. 8 is a bottom view of the structure of FIG. 7 with certain parts removed for clarity.

Positioned between the bearing adapter 22 and the pedestal roof 14 is a wear liner indicated generally at 24 in FIGS. 1, 2 and 3; at 44 in FIGS. 4, 5 and 6; at 64 in FIGS. 7, 8 and 9; and at 84 in FIGS. 10, 11 and 12. Each of these wear liners 24, 44, 64 and 84 will be described in detail hereinafter.

Referring now to the embodiment shown in FIGS. 1, 2 and 3, wear liner 24 includes liner body 26 which provides contact surfaces with the pedestal roof 14 from above and with the bearing adapter 22 from below. Wear liner 24 also includes two downwardly depending, i.e., from liner body 26, legs 28 and 30 which are sized to be received in the mutually facing recesses 32, for, in the opposing side lugs 19, this arrangement provides a degree of restraint of movement of the wear liner 24 relative to the pedestal roof 14.

Wear liner 24 also includes two pairs of mutually opposed projections 34, 35 and 36, 37 which extend upwardly from the generally flat surface of liner body 26. Projections 34, 35 and 36, 37 are positioned to receive pedestal roof 14 and to provide a certain degree of spring action to inhibit movement of the wear liner 24 relative to the pedestal roof 14. Thus, projections 34, 35 and 36, 37 cooperate with pedestal roof 14 to further inhibit or restrain movement of the wear liner 24 relative to the pedestal roof 14. The embodiment illustrated in FIGS. 1, 2 and 3 requires no physical attachment, e.g., welding, of the wear liner 24 to the pedestal roof 14.

With regard to FIGS. 4, 5 and 6, wear liner 44 includes liner body 46 which functions similarly to liner body 26, described previously. Further wear liner 44 includes two downwardly depending legs 48 and 50 which cooperate with stop lugs 19 in a manner similar to legs 28 and 30 noted above.

Wear liner 44 further includes a single pair of projections 52 and 53 extending substantially upwardly from opposing lateral edges of liner body 46. Each of the projections 52 and 53 include recesses 54 and 55, respectively. However, the bottom of each of the recesses 54 and 55 is above the upper surface of liner body 46. Projections 52 and 53 are positioned to receive pedestal roof 14 and to provide a certain degree of spring action to inhibit movement of wear liner 44 relative to pedestal roof 14. To further inhibit such movement, wear liner 44 is attached to pedestal roof 14 by welds located in the recesses 54 and 55 of projections 52 and 53. Since these welds are located a distance away from, i.e., above, the wear surfaces of the wear liner 44, these welds in recesses 54 and 55 have reduced tendency to failure.

The embodiment illustrated in FIGS. 7, 8 and 9 involves wear liner 64 which includes liner body 66. Liner body 66 functions similarly to liner bodies 26 and 46. Wear liner 64 further includes two pairs of mutually opposing depending legs 68, 69 and 70 and 71. Depending legs 68 and 70 along with liner body 66 form recess 74, while mutually facing recess 76 is defined by depending legs 69 and 71 and liner body 66. In this embodiment stop lugs 19 are formed with mutually facing extensions 79 and 80 which are sized and positioned to be received into recesses 76 and 78, respectively. In this manner stop lugs 19 cooperate with depending legs 68, 69 and 70, 71 to inhibit movement of the wear liner 64 relative to the pedestal roof 14.

Wear liner 64 further includes a single pair of substantially mutually opposing projections 81 and 82 which extend in a generally upward direction from the flat surface of liner body 66. Projections 81 and 82 are positioned to receive pedestal roof 14 and to provide a certain degree of spring action to inhibit movement of the wear liner 64 relative to the pedestal roof 14.

The present invention provides a pedestal type side frame having substantial benefits, e.g., long life, reduced maintenance and improved service reliability. Movement of the wear liner in both the longitudinal and lateral directions relative to the pedestal roof may be inhibited. Further the need for conventional, failure prone welds is reduced or eliminated and replaced by simple mechanical cooperation between various components of the side frame assembly.

While the invention has been described with respect to various specific examples and embodiments, it is to be understood that the invention is not limited thereto and that it can be variously practiced within the scope of the following claims.

What is claimed is:

1. In a pedestal type side frame with an integrally formed downwardly open jaw which includes a roof and depending legs, said legs having substantially opposed stop lugs with recessed portion, a bearing assembly received in said jaw, a bearing adapter overlying said bearing assembly, and a wear liner disposed between said roof and said adapter; the improvement wherein said wear liner includes on each side laterally spaced substantially mutually opposing projections extending upwardly from the lateral edges of said wear liner, said projections being positioned so as to engage at least a portion of the lateral edges of said pedestal roof and thereby inhibit movement of said wear liner relative to said pedestal roof, said wear liner further including at least two substantially mutually opposing downwardly depending legs having tab portions which extend downward beyond said legs, said tab portions being positioned to engage cooperating recessed portions of said stop lugs to inhibit movement of said wear liner relative to said pedestal roof.

2. The pedestal type said frame of claim 1 wherein said wear liner is attached to said pedestal roof.

3. The pedestal type side frame of claim 2 wherein at least portions of said two of said substantially mutually opposing projections engage said pedestal roof.

4. The pedestal type side frame of claim 3 wherein said projections are welded to said pedestal roof.

* * * * *